US008275164B1

(12) United States Patent
Nguyen

(10) Patent No.: US 8,275,164 B1
(45) Date of Patent: Sep. 25, 2012

(54) SPEAKER ENCLOSURES

(76) Inventor: Thach T. Nguyen, Delray Beach, FL (US)

( * ) Notice: Subject to any disclaimer, the term of this patent is extended or adjusted under 35 U.S.C. 154(b) by 211 days.

(21) Appl. No.: 12/899,946

(22) Filed: Oct. 7, 2010

(51) Int. Cl.
*H04R 1/20* (2006.01)

(52) U.S. Cl. ..... 381/338; 381/382; 381/348; 381/395; 381/337; 381/341

(58) Field of Classification Search ..... 381/338, 381/348, 353, 395, 337, 341, 339, 382; 181/152, 181/144, 155, 159, 194, 199, 156, 145, 148, 181/151, 153, 189, 187, 198
See application file for complete search history.

(56) References Cited

U.S. PATENT DOCUMENTS 1,644,795 A * 10/1927 Stevens ..... 181/194
1,748,790 A * 2/1930 Osborne ..... 181/194
1,759,614 A * 5/1930 Hall ..... 181/194
4,760,601 A 7/1988 Pappanikolaou
4,790,408 A 12/1988 Adair
D362,667 S 9/1995 Sohn
6,278,789 B1 8/2001 Potter
6,634,455 B1 * 10/2003 Yang ..... 181/156
7,450,733 B2 11/2008 Suprapmo et al.

* cited by examiner

*Primary Examiner* — Davetta W Goins
*Assistant Examiner* — Amir Etesam

(57) ABSTRACT

A transmission line speaker enclosure featuring a main enclosure, a speaker driver and an exit port in the main enclosure, exit port walls extend from the exit port into the main enclosure; and an inner sub enclosure in the main enclosure having a curved vertex facing the speaker driver and walls extending from ends of the vertex, the vertex has an angle between about 40 to 80 degrees, the vertex is either attached or separated from the magnet of the speaker driver by a gap, the vertex functions to divert sounds exiting the speaker driver between walls of the inner sub enclosure wall the main enclosure, then between the walls of the inner sub enclosure and the exit port and further out of the exit port, wherein back waves generated by the speaker driver can have total travelling distance of about ¼ wavelength of a tuned frequency.

15 Claims, 7 Drawing Sheets

SPEAKER ENCLOSURES

FIELD OF THE INVENTION

The present invention is directed to speaker enclosures, more particularly to speaker enclosures (transmission-line enclosures) configured such that the traveling distance for back waves from the speaker cone to the exit port is equal to about ¼ wavelength of the tuned frequency.

BACKGROUND OF THE INVENTION

Speaker drivers (e.g., electrodynamic speakers) are electromechanical devices used to generate sound and are commonly found in devices such as loudspeakers, televisions, and the like. Examples of speaker drivers include but are not limited to woofers, subwoofers, tweeters, super-tweeters, and rotary woofers. Speaker drivers generally comprise a diaphragm (e.g., speaker cone) mounted on a suspension system (e.g., spider, frame, etc.). A voice coil (e.g., a coil of insulated wire) is attached to the neck of the diaphragm. A fixed magnet sandwiched between a front plate and back plate is positioned in close proximity to the voice coil. Other components of speaker drivers may include a dust cap, etc.

When the electric current is applied to the voice coil (e.g., via electrical wires), a magnetic field is generated. The magnetic field interacts with the permanent magnetic field by the front and back plate attached to the fixed magnet. Depending on the polarity of the electric current, the voice coil will respond accordingly moving either back or forth causing the diaphragm (e.g., speaker cone) to move in the same fashion (e.g., forward-backward), which produces pressure differentials that travel as sound waves.

Speaker drivers are generally mounted in enclosures (e.g., box-type speaker enclosures). The sound waves of the speaker drivers thus ultimately interact with the surrounding walls of the enclosures. This can be problematic in some cases. For example, as the diaphragm (e.g., speaker cone) moves back and forth, back waves may first hit the enclosure walls and then be reflected by the enclosure walls. The reflected waves then either hit the enclosure walls again or hit the speaker cone, which can cause sound coloration and distortion (e.g., internal interaction). In some cases, the front sound waves generated by the diaphragm (e.g., speaker cone) can be reflected by the front panel, which causes smearing (e.g., external interaction).

The present invention features a speaker enclosure (e.g., transmission line enclosure) comprising an outer main enclosure and an inner sub enclosure (e.g., an even number of inner sub enclosures). The main enclosure and sub enclosure are arranged such that the back waves generated by the speaker cone can move more freely and the total traveling distance for the back waves from the speaker cone to the exit port is equal to about ¼ wavelength of the tuned frequency. In some embodiments, for example to increase bass output, a passive radiator can be installed at the exit port. Passive radiators are well known to one of ordinary skill in the art. The speaker enclosure of the present invention can be constructed in a variety of configurations, for example tube, column, box, space, and/or the like.

Without wishing to limit the present invention to any theory or mechanism, it is believed that the speaker enclosure of the present invention is advantageous because the back waves generated by the speaker cone movement may move freely due to the internal structure of the speaker enclosure. Thus, common acoustic problems such as sound reflection, diffraction, coloration, distortion, and the like may be reduced as compared to regular box-type speakers. High-quality sound can be produced from the speaker enclosures of the present invention. Also, the speaker enclosure may be less expensive to construct as compared to other types of speaker enclosures. High quality sound can be reproduced by the speaker enclosure of the present invention because commonly found acoustic problems in standard box-type enclosures may be minimized in the present invention. The speaker enclosure can be produced in a variety of configurations. In some embodiments, a form of a jacket is used for visually enhanced presentation or structurally improved speaker driver installation.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Generally, the total traveling distance from the speaker cone to the exit port of the back wave generated by the speaker driver 150 should be equal to about ¼ wavelength of the tuned frequency. Referring now to FIGS. 1-5, the present invention features a speaker enclosure 100 (e.g., a transmission line speaker enclosure). The speaker enclosure 100 is a multi chambered transmission line speaker enclosure to make the length of the speaker enclosure 100 more practical. The speaker enclosure 100 comprises an outer main enclosure 110 and an even number (e.g., 2, 4, etc.) of inner sub enclosures. The main enclosure and sub enclosure(s) are arranged such that the back waves generated by the speaker cone can move more freely and the total traveling distance for the back waves from the speaker cone to the exit port is equal to about ¼ wavelength of the tuned frequency. For example, the inner sub enclosures may be arranged in a way that the air flow generated by the back waves of the speaker driver can zigzag along the inner sub enclosures so that the total traveling distance of the back waves inside the enclosure is extended to ¼ of the tunnel frequency. Without wishing to limit the present invention to any theory or mechanism, it is believed that the speaker enclosure 100 of the present invention is advantageous because its internal structure (e.g., with airflow separator, rounded corners) has greatly reduced the internal interaction between the sound back waves and its surrounding, which can help the back waves flow smoothly to the exit port. The speaker enclosure 100 of the present invention can be constructed in a variety of configurations, for example in the shape of a tube, a rectangle (e.g., column type version, box type version), a circle (e.g., a sphere), and/or the like.

Figure 1:
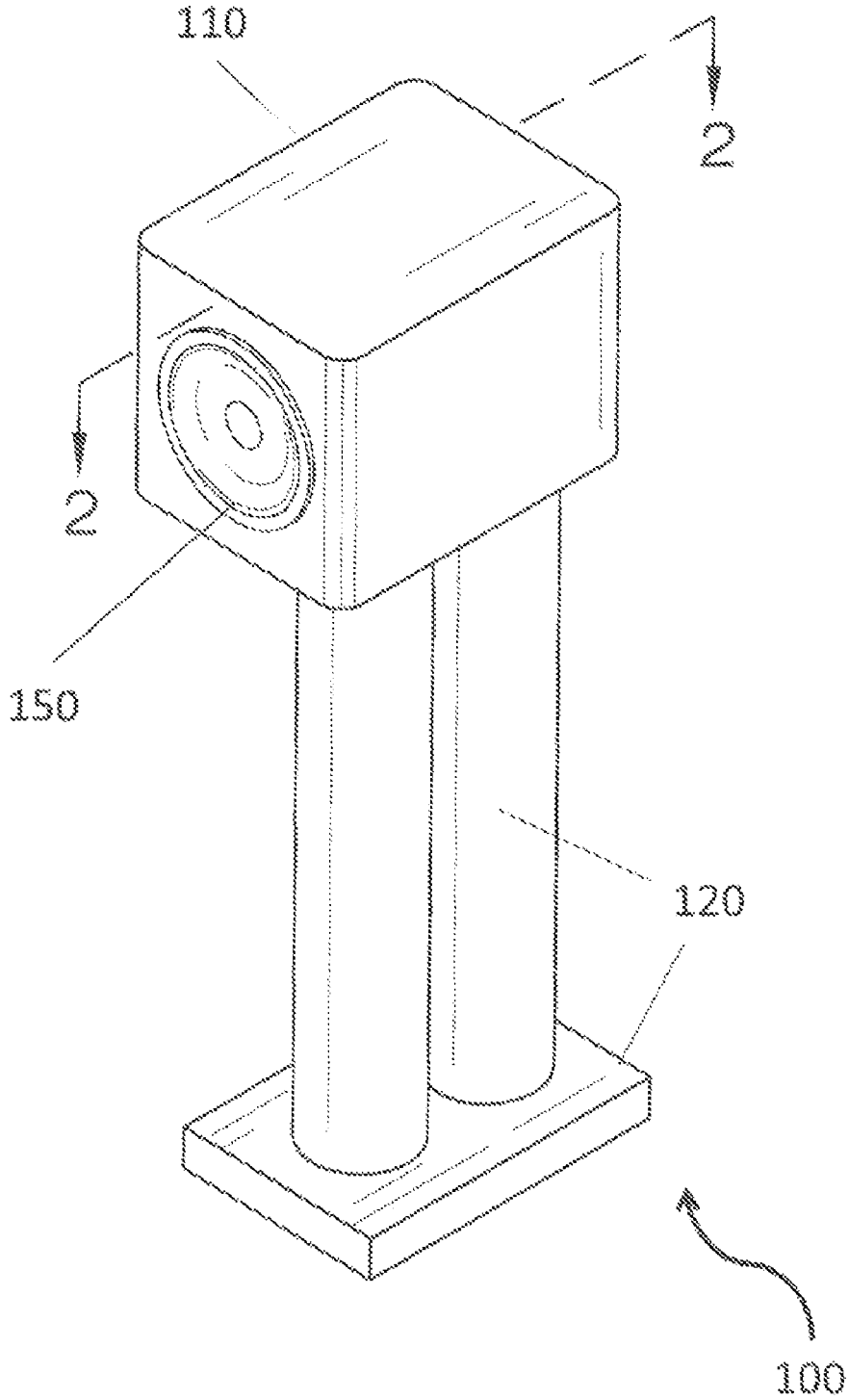
FIG. 1 is a perspective view of an embodiment of a speaker enclosure of the present invention. The speaker enclosure of the present invention may be a transmission line type speaker enclosure. The present invention may be constructed in a variety of configurations. In some embodiments, the speaker enclosure includes a form of a jacket for visually enhanced presentation or structurally improved speaker driver installation. Generally, the speaker enclosure has a low profile to help minimize the sound reflection created by the external interaction between the front sound waves and the front panel of the speaker enclosure.

Referring now to FIG. 1, the speaker enclosure 100 of the present invention comprises an outer main enclosure 110 and a speaker driver 150 disposed therein. Although not shown in FIG. 1, an exit port is disposed in the outer main enclosure 110 (e.g., on a different side of the outer main enclosure 110 than the speaker driver 150). In some embodiments, the speaker enclosure 100 (e.g., a box-type version, sphere-type version of the present invention, etc.) of the present invention is mounted on a stand component 120. In a column-type version of the speaker enclosure 100 of the present invention, the column is an integral part of the whole enclosure. The column can be covered to make it look as a stand for presentation purpose, for example.

Figure 4:
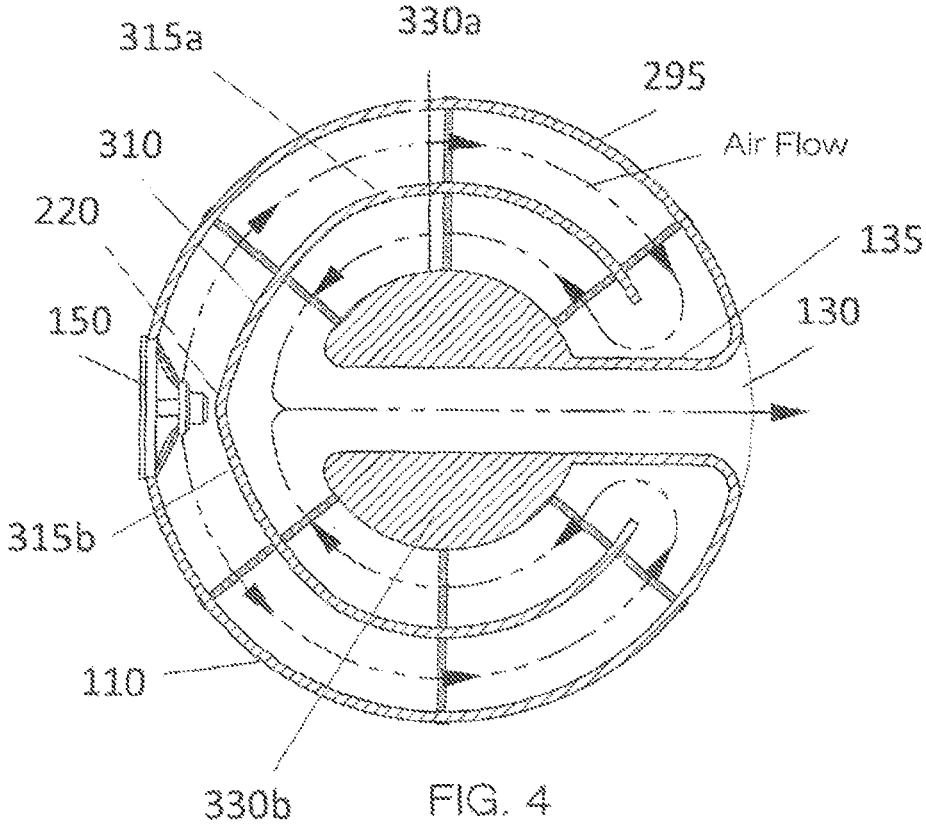
FIG. 4 is a cross sectional view of a third alternative embodiment of a speaker enclosure of the present invention.

Except in a sphere-type version (as shown in FIG. 4), the speaker enclosure 100 is a generally tube-based enclosure. In some embodiments, a tube-base enclosure is preferable to a box-type enclosure because in a tube-base enclosure, the inside pressure is equally distributed. In some embodiments, the speaker enclosure 100 can have a jacket in different shapes, for example for presentation purpose.

Except in the sphere configuration, the speaker enclosure is a tube-based enclosure with a unique arrangement of inner enclosures so that the speaker driver back waves can travel freely to ¼ wavelength of the tuned frequency in a compact enclosure. At the same time, this tube based enclosure with its unique internal structure may greatly reduce acoustic problems such as sound coloration distortion. The speaker enclosure 100 (e.g., tube based version) of the present invention comprises an outer main enclosure 110 with an inner cavity. The tube-based enclosure can have a jacket to make it look like a rectangular box type enclosure. In some embodiments, for example if a rectangular shape box type jacket is put over the tube based speaker enclosure, the outer main enclosure 110 is generally rectangular in shape and has a first side, a second side, a third side, and a fourth side.

A speaker driver 150 and an exit port 130 are disposed in the outer main enclosure 110. For example, the speaker driver 150 is disposed on the first side of the outer main enclosure 110 and the exit port 130 is disposed on the second side of the outer main enclosure 110 opposite the first side. The magnet 140 of the speaker driver 150 faces in the inner cavity of the outer main enclosure 110.

Figure 2A:
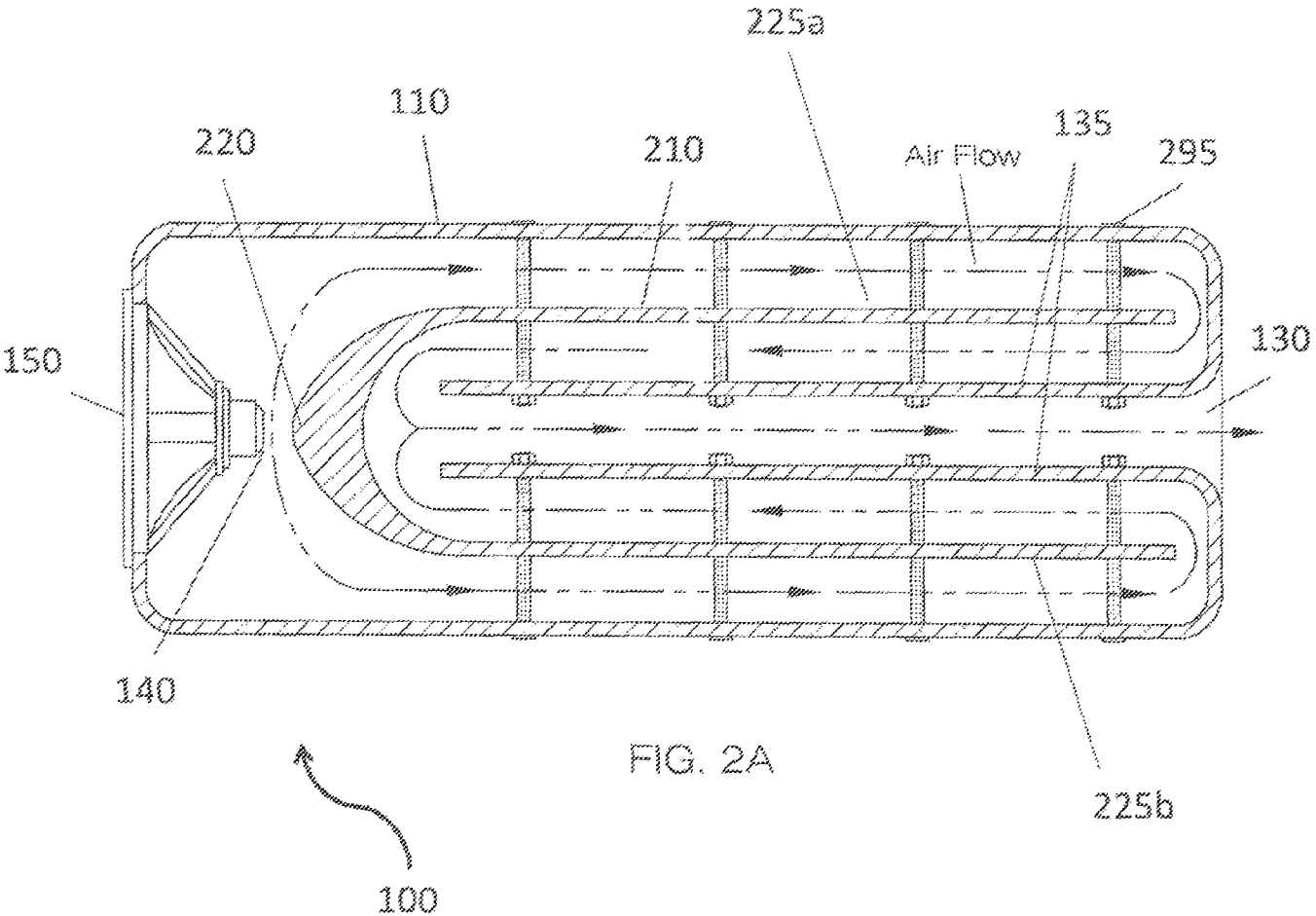
FIG. 2A is a cross sectional view of the speaker enclosure of FIG. 1.
Figure 2B:
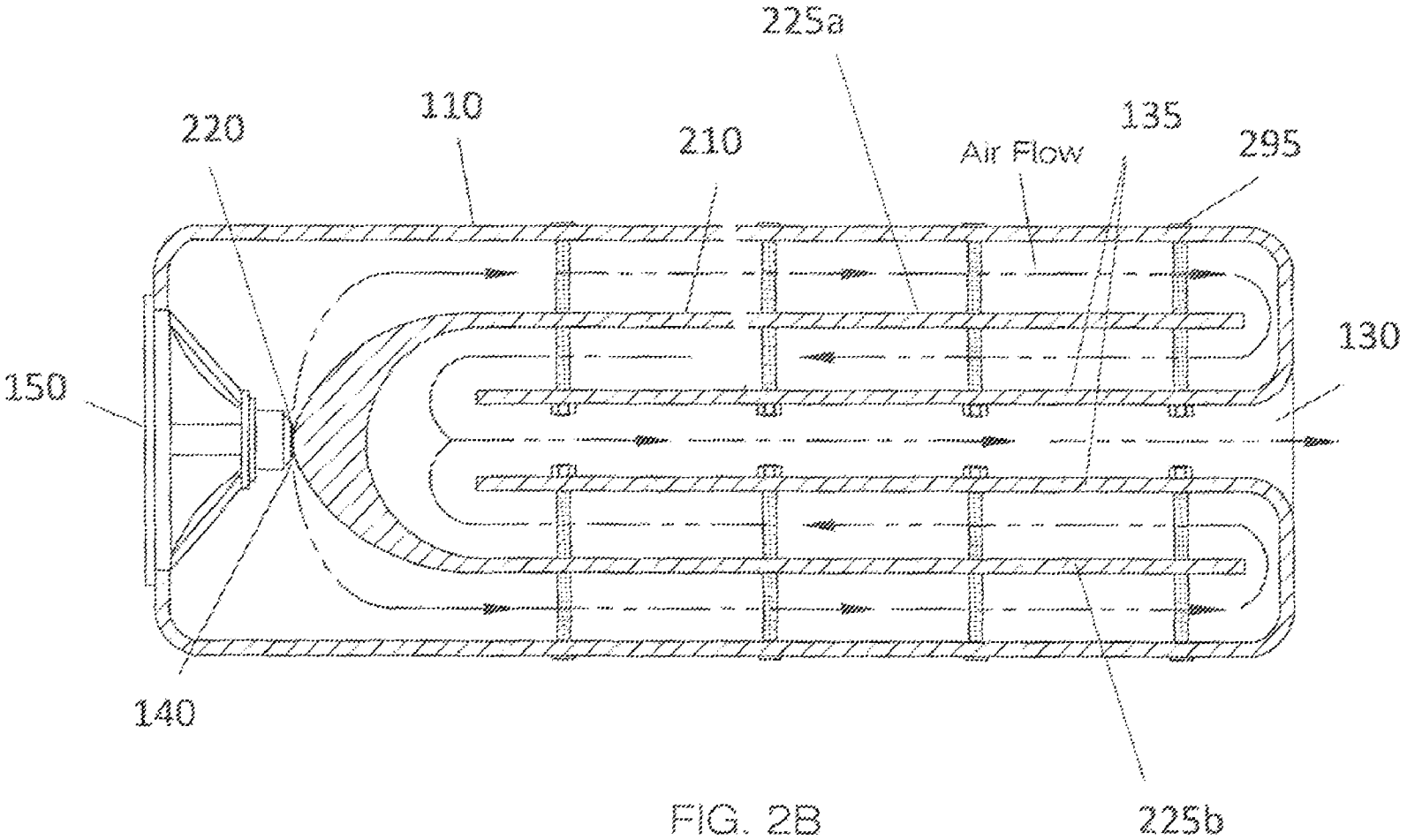
FIG. 2B is a cross sectional view of a first alternative embodiment of a speaker enclosure of the present invention.

In some embodiments, the walls 135 (e.g., first wall, second wall) of the exit port 130 extend into the inner cavity of the outer main enclosure 110. For example, FIG. 2A and FIG. 2B show the exit port walls 135 extending into the inner cavity of the outer main enclosure 110 a distance between about ½ to ¾ (e.g., ⅔) the length of the outer main enclosure 110 (e.g., as measured from the first side to the second side). The exit port walls 135 of are not limited to this length.

An elongated inner sub enclosure wall 210 is disposed in the inner cavity of the outer main enclosure 110. The inner sub enclosure wall 210 forms two pairs (e.g., symmetrical pairs) of inner sub enclosures (with the exit port walls 135) inside the main enclosure 110. The inner sub enclosure wall 210 comprises a generally V-shaped vertex 220 positioned facing the magnet 140 of the speaker driver 150 (e.g., the tip of the vertex 220 is positioned near the magnet 140). The inner sub enclosure wall 210 further comprises a first outer wall 225*a* that extends from the first end of the vertex 220 and a second outer wall 225*b* that extends from the second end of the vertex 220. In some embodiments, the ends of the first outer wall 225*a* and second outer wall 225*b* face the side of the outer main enclosure 110 with the exit port 130. As shown in FIG. 2A and FIG. 2B, the first outer wall 225*a* is positioned between the third side of the outer main enclosure 110 and the first exit port wall 135 (with spaces between), and the second outer wall 225*b* is positioned between the fourth side of the outer main enclosure 110 and the second exit port wall 135 (with spaces between).

Figure 2C:
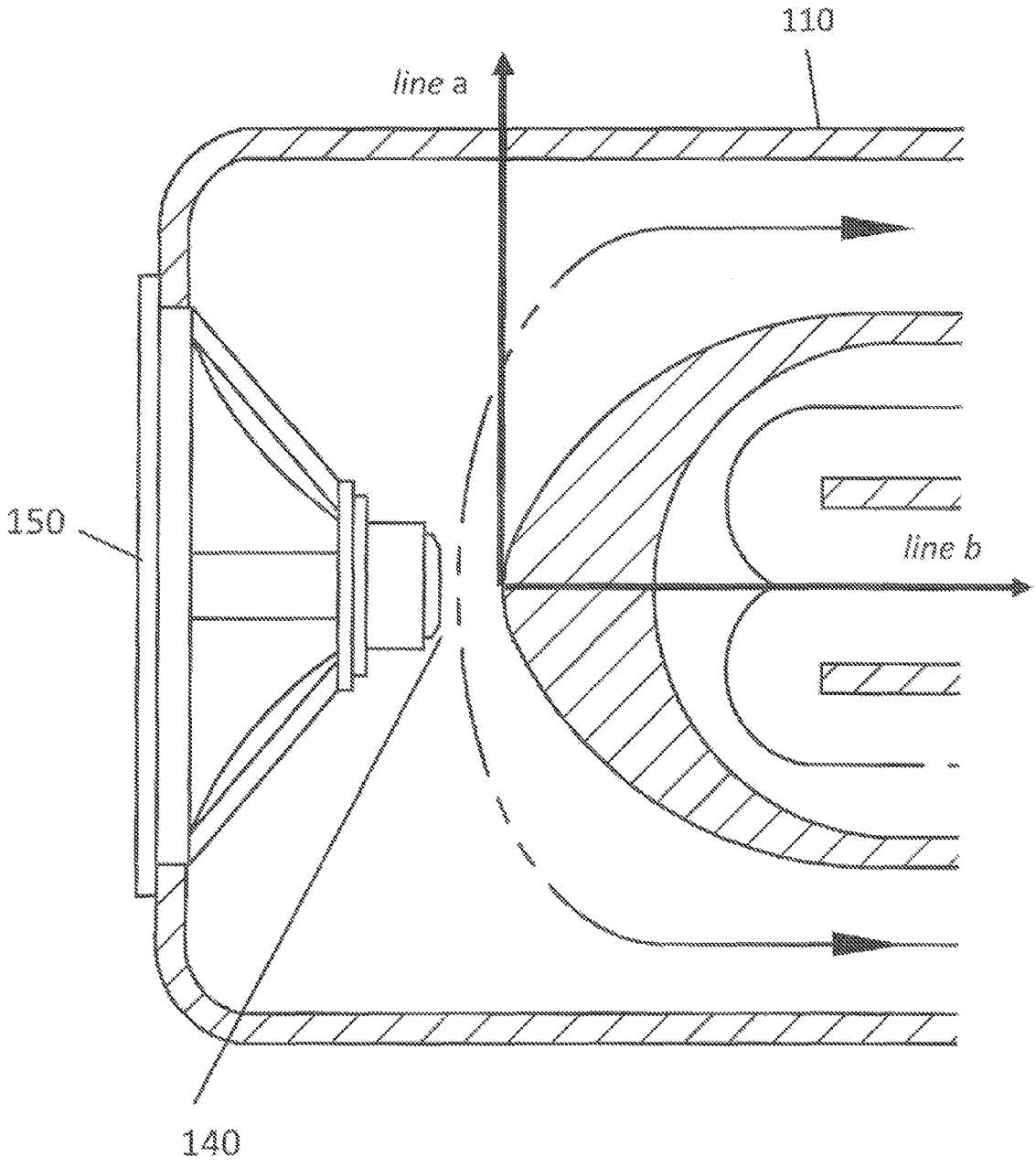
FIG. 2C is a detailed view of the vertex of the speaker enclosure of FIG. 2A, showing the angle of the vertex as being the angle between line a and line b.

The vertex 220 is generally part of a solid bloc of the sub enclosure wall 210 and may be called a "solid bloc of airflow separator". The vertex 220 (e.g., solid bloc of airflow separator) has a curved vertex shape outside (e.g., facing the speaker driver 150) and rounded curved shape inside (e.g., facing the exit port 130). In some embodiments, the curved vertex shape of the outside portion of the vertex 220 has an angle of about 60 degrees (as measured between fine a and line b as shown in FIG. 2C). In some embodiments, the curved vertex shape of the outside portion of the vertex 220 has an angle between about 40 to 60 degrees (as measured between line a and line b as shown in FIG. 2C). In some embodiments, the curved vertex shape of the outside portion of the vertex 220 has an angle between about 60 to 80 degrees (as measured between line a and line b as shown in FIG. 2C).

The primary function of the vertex 220 (e.g., solid bloc of airflow separator) is to direct the back waves from the speaker driver flowing along both sides of the enclosure walls. The vertex 220 can be either securely attached to the speaker driver magnet back plate or separated form the speaker magnet 140 back plate (by a small gap). In the case the vertex 220 is separated from the speaker magnet back plate (as shown in FIG. 2A), the gap or clearance between the vertex 220 and magnet 140 can be varied depending on the size of the speaker driver 150. For example, in some embodiments, the bigger the speaker driver 150, the wider the gap. In some embodiments, the gap is about ⅓ to ½ the size of the speaker driver 150. In a column type speaker enclosure of the present invention, the vertex 220 may be separated from the speaker driver magnet 140 at least ½ of the speaker driver size (and below the voice coil horizontal ax). In the case the vertex 220 is separated from the speaker driver magnet back plate, it offers a possible advantage of speaker driver interchangeability, for example, the speaker driver of the same size from various manufacturers can be quickly installed in the speaker enclosure 100 without any enclosure modification due to the speaker driver depth or other mechanical and electrical characteristics of the speaker driver. In some embodiments, the gap between the vertex 220 and the magnet 140 is between about 1 to 5 mm. In some embodiments, the gap is between about 5 to 10 mm. In some embodiments, the gap is between about 10 to 20 mm. In some embodiments, the gap is more than about 20 mm.

The vertex 220 can be securely attached to the speaker driver magnet 140 (e.g., see FIG. 2B) (except for column type speaker enclosures). In this case, the inner sub enclosure 210 may behave (e.g., will behave) as an additional mechanical support for the speaker driver 150. This may increase (e.g., will increase) the rigidity for speaker driver mounting. As a result, sound clarity details may be (e.g., will be) enhanced due to reduced speaker driver vibration.

As shown in FIG. 2A and FIG. 2B, one or more screws 295 or bolts may span the wall of the outer main enclosure 110, the walls 225 of the inner sub enclosure 225, and the exit port walls 135. The present invention is not limited to this configuration.

In some embodiments, the main function of the inner sub enclosure 210 is to provide a traveling passage to the back waves generated by the speaker cone of the speaker driver 150. To make the back waves smoother, the vertex 220 of the inner sub enclosure 210 has a curved vertex shape. The purpose of the vertex 220 is to divert and separate airflow to the sides (of the main enclosure 110), reducing the back waves bounced back to the speaker cone of the speaker driver 150. In a column-type speaker enclosure, the vertex 220 is separated from the speaker magnet 140 back plate. The gap varies, depending on the size of the speaker cone (e.g., the gap may be about ⅓ to ½ of the speaker cone size). Without wishing to limit the present invention to any theory or mechanism, the gap should be wide enough so that the air flow of the back waves can move smoothly and freely. In a box-type or sphere-type enclosure, the vertex 220 can be either separated from the speaker magnet 140 back plate about ½ to ½ of the speaker driver size or securely attached to the speaker magnet 140 back plate. In case of separation, the vertex 220 can have an angle varying from 40 degrees to 80 degrees (as described above).

The vertex 220 diverts the air flow of the speaker driver waves moving smoothly to the side an along the enclosure walls and minimizes the back waves' reflection to the speaker cone. This in turn increases the quality of reproduced sound. For example, as shown in FIG. 2A and FIG. 2B, sound waves exiting the speaker driver 150 (e.g., magnet 140) are diverted via the vertex 220 either (a) between the first outer wall 225*a* of the inner sub enclosure wall 210 and the third side of the outer main enclosure 110, or (b) between the second outer wall 225*b* of the inner sub enclosure wall 210 and the fourth side of the outer main enclosure 110. From between the first outer wall 225*a* of the inner sub enclosure wall 210 and the third side of the outer main enclosure 110, the sound waves then travel between the first outer wall 225*a* of the inner sub enclosure wall 210 and an exit port wall 135, then through the exit port walls 135 and exit port 130. From between the second outer wall 225*b* of the inner sub enclosure wall 210 and the fourth side of the outer main enclosure 110, the sound waves then travel between the second outer wall 225*b* of the inner sub enclosure wall 210 and an exit port wall 135, then through the exit port walls 135 and exit port 130 (see "air flow" arrows in FIG. 2A and FIG. 2B).

The configuration of the vertex 220 and the gap allow the sound leaving the speaker driver 150 (e.g., magnet 140) to be fractionated by the vertex 220 of the inner sub enclosure wall 210 immediately or almost immediately. Without wishing to limit the present invention to any theory or mechanism, it is believed that the configuration of the vertex 220 and the gap provide increased sound quality.

Figure 3:
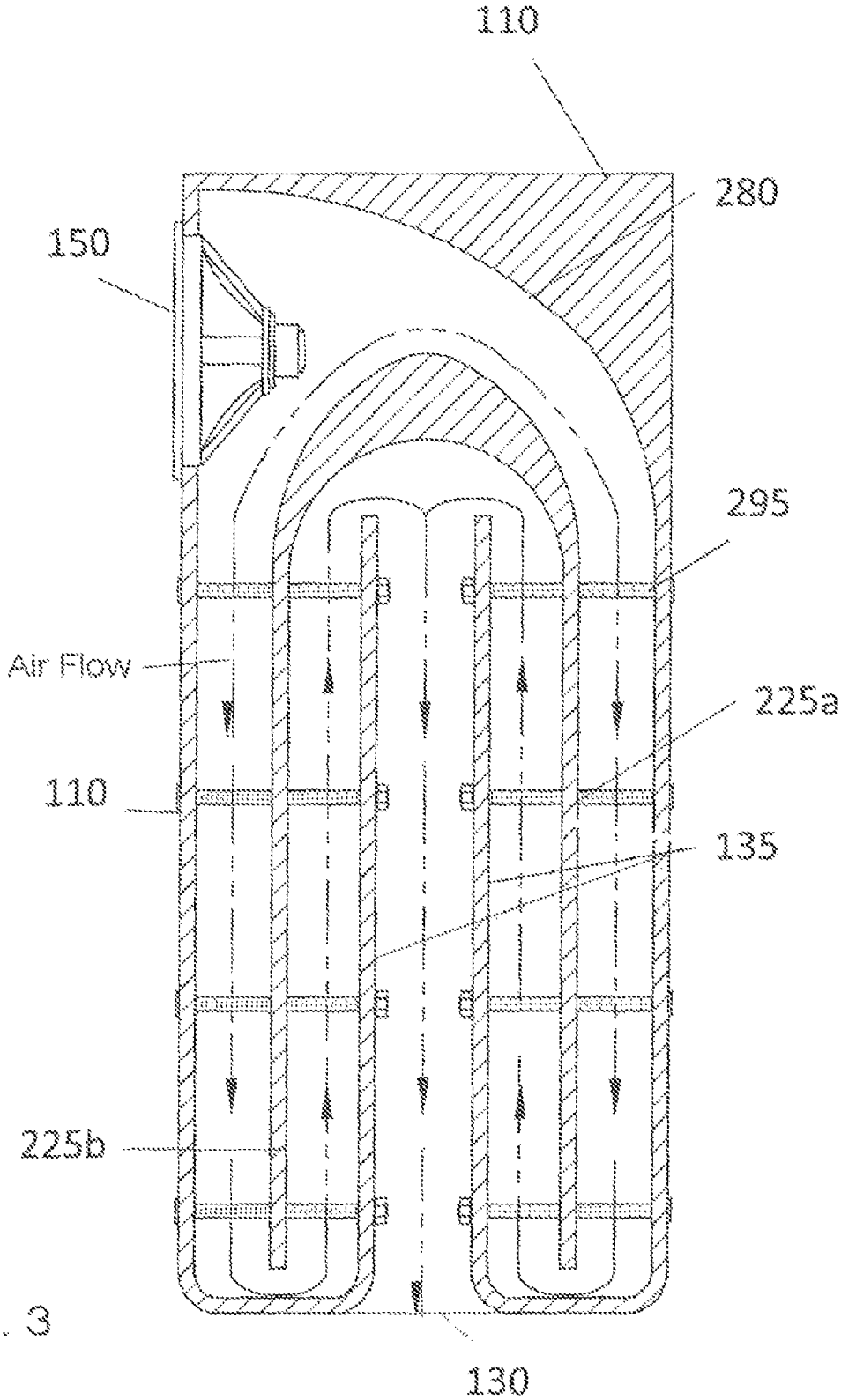
FIG. 3 is a cross sectional view of a second alternative embodiment of a speaker enclosure of the present invention.

Referring now to FIG. 3, in some embodiments, the speaker driver is disposed on the fourth side of the outer main enclosure 110 while the exit port 130 is disposed on the second side of the outer main enclosure 110 (e.g., the speaker driver 150 is not opposite the exit port 130). The magnet 140 of the speaker driver 150 is positioned so as to slightly face the second end of the vertex 220 (and the tip). A curvature 280 is disposed in the inner cavity of the outer main enclosure 110 opposite the speaker driver 150. For example, the curvature 280 is disposed in the corner of the outer main enclosure 110 at the intersection of the first side and the third side. The curvature 280 can smoothly divert the air flow. Sound waves exiting the speaker driver 150 (e.g., magnet 140) are diverted via either the vertex 220 or the curvature 280. The sound waves then travel either (a) between the first outer wall 225*a* of the inner sub enclosure wall 210 and the third side of the outer main enclosure 110, or (b) between the second outer wall 225*b* of the inner sub enclosure wall 210 and the fourth side of the outer main enclosure 110. From between the first outer wall 225*a* of the inner sub enclosure wall 210 and the third side of the outer main enclosure 110, the sound waves then travel between the first outer wall 225*a* of the inner sub enclosure wall 210 and an exit port wall 135, then through the exit port walls 135 and exit port 130. From between the second outer wall 225*b* of the inner sub enclosure wall 210 and the fourth side of the outer main enclosure 110, the sound waves then travel between the second outer wall 225*b* of the inner sub enclosure wall 210 and an exit port wall 135, then through the exit port walls 135 and exit port 130 (see "air flow" arrows in FIG. 3).

Referring now to FIG. 4 (e.g., a sphere type speaker enclosure), in some embodiments, the outer main enclosure 110 is generally circular, spherical. A speaker driver 150 and an exit port 130 are disposed in the outer main enclosure 110. For example, the speaker driver 150 is disposed in a first end of the outer main enclosure 110 and the exit port 130 is disposed in a second end of the outer main enclosure 110, for example opposite the first side. The magnet 140 of the speaker driver 150 faces in the inner cavity of the outer main enclosure 110. The vertex 220 of the inner sub enclosure 210 (behind the speaker magnet 14) has a generally curved vertex shape in order to reduce the reflection of the speaker driver back waves. The vertex 220 can be a bit leveled off and securely attached to the speaker magnet back plate to further increase the rigidity of the speaker support.

In some embodiments, the walls 135 of the exit port 130 extend into the inner cavity of the outer main enclosure 110. For example, FIG. 4 shows the exit port walls 135 extending into the inner cavity of the outer main enclosure 110 a distance of about ⅔ the length of the outer main enclosure 110 (e.g., as measured from the first end to the second end). The exit port walls 135 of are not limited to this length. For example, the exit port walls 135 may extend into the inner cavity of the outer main enclosure 110 a distance between about % to ¾ the length of the outer main enclosure 110 (e.g., as measured from the first end to the second end).

A generally C-shaped inner sub enclosure 310 is disposed in the inner cavity of the outer main enclosure 110. The C-shaped inner sub enclosure comprises a first arm 315*a* and a second arm 315*b* joined at a center (vertex 220). The center (vertex 220) of the C-shaped inner sub enclosure wall 210 is positioned facing the magnet 140 of the speaker driver 150. The first arm 315*a* of the C-shaped inner sub enclosure 310 is positioned between the wall of the outer main enclosure 110 and the first exit port wall 135 (with spaces between), and the second arm 315*b* is positioned between the wall of the outer main enclosure 110 and the second exit port wall 135 (with spaces between). In some embodiments, a first curvature 330*a* is disposed on the first exit port wall 135 and a second curvature 220*b* is disposed on the second exit port wall 135. Spaces exist between the first curvature 330*a* and the first arm 315*a* and between the second curvature 330*b* and the second arm 315*b*.

In some embodiments, the center vertex 220 of the inner sub enclosure 310 and the magnet 140 of the speaker driver 150 are separated by a small gap. In some embodiments, the gap is between about 1 to 5 mm. In some embodiments, the gap is between about 5 to 10 mm. In some embodiments, the gap is between about 10 to 20 mm. In some embodiments, the gap is more than about 20 mm.

As shown in FIG. 4, sound waves exiting the speaker driver 150 (e.g., magnet 140) are diverted via the center vertex 220 of the inner sub enclosure 310 and travel either (a) between the first arm 315*a* of the inner sub enclosure wall 210 and the wall of the outer main enclosure 110, or (b) between the second arm 315*b* of the inner sub enclosure 310 and the outer wall of the outer main enclosure 110. From between the first arm 315*a* of the inner sub enclosure 310 and the wall of the outer main enclosure 110, the sound waves then travel between the first arm 315*a* of the inner sub enclosure 310 and the first curvature 330*a*, then through the exit port walls 135 and exit port 130. From between the second arm 315*b* of the inner sub enclosure 310 and the outer wall of the outer main enclosure 110, the sound waves then travel between the second arm 315*b* of the inner sub enclosure 310 and the second curvature 330*b*, then through the exit port walls 135 and exit port 130 (see "air flow" arrows in FIG. 4).

Figure 5A:
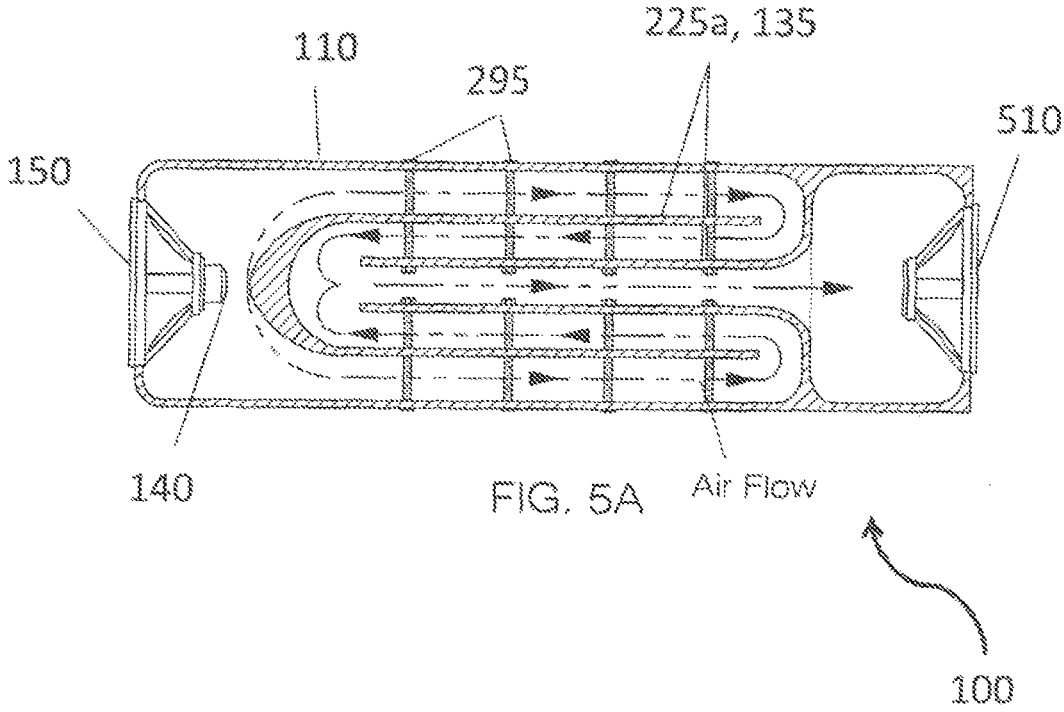
FIG. 5A is a cross sectional view of a fourth alternative embodiment of a speaker enclosure of the present invention.
Figure 5B:
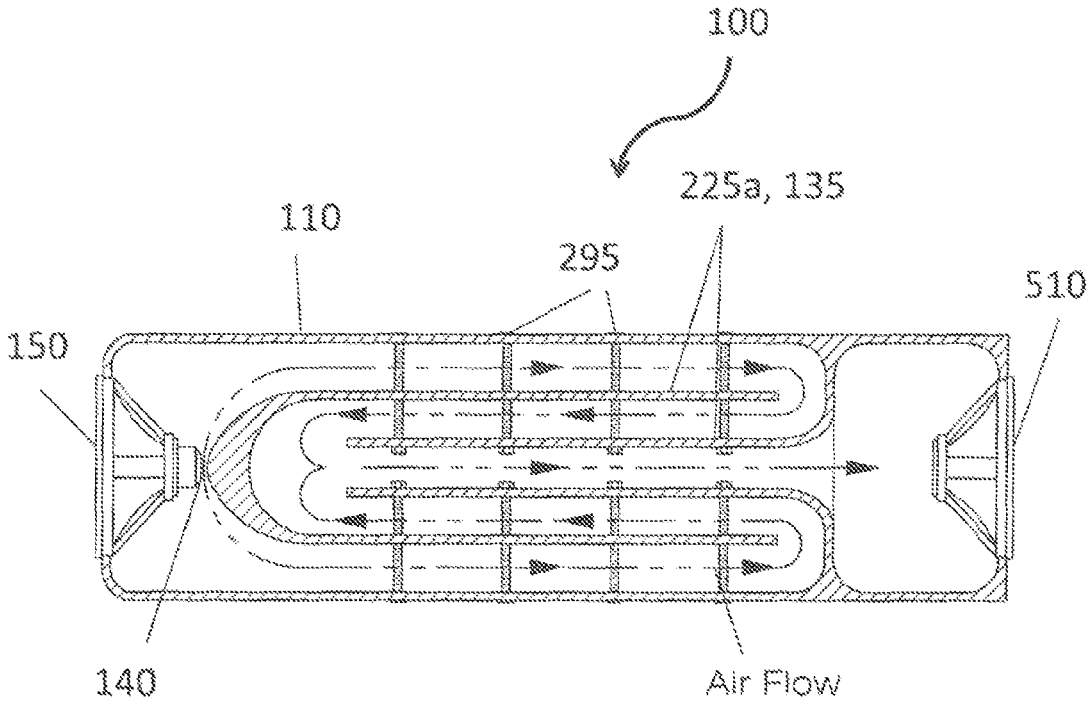
FIG. 5B is a cross sectional view of a fifth alternative embodiment of a speaker enclosure of the present invention.

Referring now to FIG. 5A and FIG. 5B, in some embodiments the speaker enclosure 100 of the present invention further comprises a passive radiator 510. Passive radiators are well known to one of ordinary skill in the art. For example, a passive radiator resembles a standard speaker driver lacking a voice coil and magnet assembly. Passive radiators may be used for a variety of reasons, for example to tune the small volume and driver for better low frequency performance or to help eliminate port turbulence and reduce motion compression caused by high velocity airflow in small ports. In some embodiments, a passive radiator can be installed behind the exit port 130 (e.g., as shown in FIG. 5A and FIG. 5B). This may allow acoustic energy to be used to generate more bass output. In some embodiments, to reduce air turbulence, all corners of the enclosure 100 are rounded off.

The speaker enclosures 100 of the present invention provide a compact resonance cavity, whereby the preferred % wavelength would be obtained through a multi-chamber enclosure having a zigzag configuration to fit the resonant cavity structure within a compact speaker enclosure.

Without wishing to limit the present invention to any theory or mechanism, it is believed that the speaker enclosures 100 of the present invention are advantageous because of the tube-based enclosure (except in the sphere configuration); a unique internal structure to have a % wavelength of the tuned frequency for the speaker driver back waves in a compact enclosure; and/or the construction with a vertex used as an air flow separator to make the back waves flow more smoothly.

As used herein, the term "about" refers to plus or minus 10% of the referenced number. For example, an embodiment wherein the gap is about 60 degrees includes a gap between 54 and 66 degrees.

The following the disclosures of the following U.S. patents are incorporated in their entirety by reference herein: U.S. Pat. No. 7,450,733; U.S. Pat. No. 6,634,455; U.S. Pat. No. 4,790,408; U.S. Pat. No. 6,278,789; U.S. Pat. No. 4,760,601.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A generally tube-based transmission line speaker enclosure comprising:

(a) an outer main enclosure with an inner cavity;

(b) a speaker driver disposed in a first side of the outer main enclosure, a magnet of the speaker driver faces the inner cavity of the outer main enclosure;

(c) an exit port disposed in a second side of the outer main enclosure opposite the speaker driver, wherein a first exit port wall and second exit port wall each extend into the inner cavity of the outer main enclosure a distance between about ¼ to ¾ a length of the outer main enclosure as measured from the first side to the second side; and (d) an inner sub enclosure wall disposed in the inner cavity of the outer main enclosure, the inner sub enclosure comprises a vertex having a generally curved V-shaped outside and a rounded inside, the outside of the vertex facing the magnet of the speaker driver, a first outer wall extending from a first end of the vertex, and a second outer wall extending from a second end of the vertex, the first outer wall is positioned between a third side of the outer main enclosure and the first exit port wall with spaces between, the second outer wall is positioned between a fourth side of the outer main enclosure and the second exit port wall with spaces between, the outside of the vertex has an angle of between about 40 to 80 degrees, wherein the vertex is either separated from the magnet of the speaker driver by a gap or is securely attached to the magnet of the speaker driver, the gap being between about ½ to ½ a size of the speaker driver, wherein sounds waves exiting the speaker driver are diverted via the vertex either (a) between the first outer wall of the inner sub enclosure wall and the third side of the outer main enclosure, then between the first outer wall of the inner sub enclosure wall and the first exit port wall, then through the exit port walls and exit port, or (b) between the second outer wall of the inner sub enclosure wall and the fourth side of the outer main enclosure, then between the second outer wall of the inner sub enclosure wall and the second exit port wall, then through the exit port walls and exit port, wherein back waves generated by the speaker driver can have total travelling distance from a speaker cone of the speaker driver to the exit port of about ¼ wavelength of a tuned frequency.

2. The speaker enclosure of claim 1 further comprising a stand component for mounting the speaker enclosure.

3. The speaker enclosure of claim 1 comprising an even number of inner enclosures formed by the inner sub enclosure wall, the outer main enclosure, and the first exit port wall and second exit port wall.

4. The speaker enclosure of claim 1 further comprising or more screws or bolts spanning from a side of the outer main enclosure through a wall of the inner sub enclosure and through an exit port wall.

5. The speaker enclosure of claim 1 further comprising a passive radiator installed behind the exit port.

6. A generally tube-based transmission line speaker enclosure comprising:

(a) an outer main enclosure with an inner cavity, a curvature is disposed in the inner cavity at an intersection of a first side and a third side;

(b) a speaker driver disposed in a fourth side of the outer main enclosure opposite the curvature, a magnet of the speaker driver faces the curvature of the outer main enclosure;

(c) an exit port disposed in a second side of the outer main enclosure, wherein a first exit port wall and second exit port wall each extend into the inner cavity of the outer main enclosure a distance between about ¼ to ¾ a length of the outer main enclosure as measured from the first side to the second side; and (d) an inner sub enclosure wall disposed in the inner cavity of the outer main enclosure, the inner sub enclosure comprises a vertex having a generally curved V-shaped outside and a rounded inside, the outside of the vertex generally facing the magnet of the speaker driver and the curvature of the outer main enclosure, a first outer wall extending from a first end of the vertex, and a second outer wall extending from a second end of the vertex, the first outer wall is positioned between a third side of the outer main enclosure and the first exit port wall with spaces between, the second outer wall is positioned between a fourth side of the outer main enclosure and the second exit port wall with spaces between, the outside of the vertex has an angle of between about 40 to 80 degrees, wherein the vertex is either separated from the magnet of the speaker driver by a gap or is securely attached to the magnet of the speaker driver, the gap being between about ½ to ½ a size of the speaker driver, wherein sounds waves exiting the speaker driver are diverted via the vertex and curvature either (a) between the first outer wall of the inner sub enclosure wall and the third side of the outer main enclosure, then between the first outer wall of the inner sub enclosure wall and the first exit port wall, then through the exit port walls and exit port, or (b) between the second outer wall of the inner sub enclosure wall and the fourth side of the outer main enclosure, then between the second outer wall of the inner sub enclosure wall and the second exit port wall, then through the exit port walls and exit port, wherein back waves generated by the speaker driver can have total travelling distance from a speaker cone of the speaker drive to the exit port of about ¼ wavelength of a tuned frequency.

7. The speaker enclosure of claim 6 further comprising a stand component for mounting the speaker enclosure.

8. The speaker enclosure of claim 6 comprising an even number of inner enclosures formed by the inner sub enclosure wall, the outer main enclosure, and the first exit port wall and second exit port wall.

9. The speaker enclosure of claim 6 further comprising or more screws or bolts spanning from a side of the outer main enclosure through a wall of the inner sub enclosure and through an exit port wall.

10. The speaker enclosure of claim 6 further comprising a passive radiator.

11. A transmission line speaker enclosure comprising:

(a) a generally spherical outer main enclosure with an inner cavity;

(b) a speaker driver disposed in a first end of the outer main enclosure, a magnet of the speaker driver faces the inner cavity of the outer main enclosure;

(c) an exit port disposed in a second end of the outer main enclosure opposite the speaker driver, wherein a first exit port wall and second exit port wall each extend into the inner cavity of the outer main enclosure a distance between about ¼ to ¾ a length of the outer main enclosure as measured from the first end to the second end, a first curvature is disposed on the first exit port wall and a second curvature is disposed on the second exit port wall; and (d) a generally C-shaped inner sub enclosure wall disposed in the inner cavity of the outer main enclosure, the inner sub enclosure comprises a center vertex having a generally curved V-shaped outside that faces the magnet of the speaker driver, a first arm extending from a first end of the vertex, and a second arm extending from a second end of the vertex, the first arm is positioned between a wall of the outer main enclosure and the first curvature of the first exit port wall with spaces between, the second arm is positioned between a wall of the outer main enclosure and the second curvature of the second exit port wall with spaces between, the outside of the vertex has an angle of between about 40 to 80 degrees, wherein the vertex is either separated from the magnet of the speaker driver by a gap or is securely attached to the magnet of the speaker driver, the gap being between about ½ to ½ a size of the speaker driver, wherein sounds waves exiting the speaker driver are diverted via the center vertex either (a) between the first arm of the inner sub enclosure wall and a wall of the outer main enclosure, then between the first arm of the inner sub enclosure wall and the first curvature, then through the exit port walls and exit port, or (b) between the second arm of the inner sub enclosure wall and a wall of the outer main enclosure, then between the second arm of the inner sub enclosure wall and the second curvature, then through the exit port walls and exit port, wherein back waves generated by the speaker driver can have total travelling distance from a speaker cone of the speaker drive to the exit port of about ¼ wavelength of a tuned frequency.

12. The speaker enclosure of claim 11 further comprising a stand component for mounting the speaker enclosure.

13. The speaker enclosure of claim 11 comprising an even number of inner enclosures formed by the inner sub enclosure wall, the outer main enclosure, and the first exit port wall and second exit port wall.

14. The speaker enclosure of claim 11 further comprising or more screws or bolts spanning from a side of the outer main enclosure through a wall of the inner sub enclosure and through an exit port wall.

15. The speaker enclosure of claim 11 further comprising a passive radiator installed behind the exit port.

* * * * *